United States Patent [19]

Cael

[11] Patent Number: 4,475,984

[45] **Date of Patent: * Oct. 9, 1984**

[54] PROCESS FOR PRETREATING WOOD CHIPS WITH MONOPEROXY SULFURIC ACID OR ITS SALTS PRIOR TO ALKALINE PULPING

[75] Inventor: John J. Cael, Washingtonville, N.Y.

[73] Assignee: International Paper Co., New York, N.Y.

[ * ] Notice: The portion of the term of this patent subsequent to Sep. 13, 2000 has been disclaimed.

[21] Appl. No.: 506,173

[22] Filed: Jun. 20, 1983

Related U.S. Application Data

[62] Division of Ser. No. 293,752, Aug. 17, 1981, Pat. No. 4,406,061.

[51] Int. Cl.[3] ..... D21C 1/04; D21C 3/02

[52] U.S. Cl. ..... 162/76; 162/78

[58] Field of Search ..... 162/76, 78, 19; 8/110, 8/111

[56] References Cited

U.S. PATENT DOCUMENTS

| | | | |
|---|---|---|---|
| 2,353,823 | 7/1944 | Hampel | 8/106 |
| 2,388,592 | 11/1945 | Asplund et al. | 92/6 |
| 2,528,351 | 10/1950 | Farber | 92/13 |
| 2,739,034 | 3/1956 | Fell | 8/128 |
| 3,351,419 | 11/1967 | Fell et al. | 8/17 |
| 3,353,902 | 11/1967 | Diamond et al. | 8/110 |
| 3,467,574 | 9/1969 | West | 162/24 |
| 4,404,061 | 9/1983 | Cael | 162/76 |

FOREIGN PATENT DOCUMENTS 884748 3/1959 United Kingdom .

OTHER PUBLICATIONS

William Gardner, Chemical Synonyms and Trade Names, Nov. 1968, Sixth Edition, p. 435.

Interscience Publishers, Inc., N.Y., 1960, Pulp and Paper; Chemistry and Chemical Technology, Second Edition, p. 395.

ABIPC, vol. 49, No. 5, (Nov. 1978).

ABIPC, vol. 49, No. 9, (Mar. 1979).

Institute of Paper Chemistry, Zakis and Neiberte, Action of Persulfate on Lignin I. Delignification . . . , Khim. Drev. (Riga) 9: 109–117, (1971).

*Primary Examiner*—Steve Alvo

*Attorney, Agent, or Firm*—Royal E. Bright

[57] ABSTRACT

Treatment of lignocellulosic materials with monoperoxysulfate to permit more ready separation of non-cellulosic materials therefrom to produce papermaking pulps is disclosed.

2 Claims, No Drawings

PROCESS FOR PRETREATING WOOD CHIPS WITH MONOPEROXY SULFURIC ACID OR ITS SALTS PRIOR TO ALKALINE PULPING

This application is a division of application Ser. No. 293,752, filed Aug. 17, 1981, now U.S. Pat. No. 4,406,061.

BACKGROUND OF THE INVENTION

This invention is related to the art of pulping and bleaching lignocellulosic materials to prepare pulps for the manufacture of paper, more specifically to the use of monoperoxysulfates therein.

The use of organic peracids and their salts in a pretreatment step to improve the results obtained from standard alkaline pulping processes and as bleaches for the products of such pulping processes are known.

The present invention concerns the use of monopersulfuric acid and its salts in place of such organic peracids. The use of monopersulfates in such fashion has, to applicant's knowledge, not been previously suggested, nor have they been used in a way which would suggest to a pulp and paper chemist that monopersulfates would perform in pulping and bleaching of lignocellulosic materials in a fashion similar to that of organic peracids, or for that matter, that they may be employed under non-extreme conditions in the treatment of cellulose containing materials to assist in and improve the separation of non-cellulosic materials therefrom.

CITATION OF RELEVANT ART

Applicant is aware of the following references:

U.S. Pat. No. 2,353,823
U.S. Pat. No. 2,388,592
U.S. Pat. No. 2,528,351
U.S. Pat. No. 2,739,034
U.S. Pat. No. 3,351,419
U.S. Pat. No. 3,353,902
U.S. Pat. No. 3,467,574
USSR Pat. No. 604,887, Khim. Drev. (Riga) No. 3, 71–80 (May/June 1978) (Russ.)
Khim Drev. (Riga) No. 9: 109–117 (1971).

SUMMARY OF THE INVENTION

The invention provides a process comprising the treatment of lignocellulosic materials with monoperoxysulfuric acid or its salts with cations.

The tangible embodiments produced by this process aspect of the invention possess the inherent applied use characteristics of being lignocellulosic materials from which the non-cellulosic materials are more readily separated from cellulose thereby indicating usefulness in producing pulp or bleaching pulp for use in papermaking.

The invention also provides in a subgeneric process aspect a process for treating unpulped lignocellulosic material prior to conventional alkaline pulping which comprises treating said unpulped lignocellulosic material with monopersulfuric acid or a salt thereof.

The invention also provides in another subgeneric process aspect a process for bleaching pulp produced by conventional alkaline pulping of lignocellulosic material which comprises treating lignocellulosic pulp produced by said conventional alkaline pulping processes with monopersulfuric acid or a salt thereof.

DESCRIPTION OF THE PREFERRED EMBODIMENT

The manner of practicing the process of the invention will now be specifically illustrated with reference to specific embodiments thereof, namely:

Treatment of northern softwood chips with potassium monoperoxysulfate to prepare chips more readily pulped in alkaline pulping processes and bleaching of nothern hardwood kraft pulp with potassium monoperoxysulfate.

Northern softwood chips may be steeped in a solution containing monopersulfate, conveniently as potassium monopersulfate ($KHSO_5$), conveniently about ten percent by weight $KHSO_5$ based on the dry weight of wood at a liquor to wood ratio of 7.6 parts by weight liquor to 1.0 parts by weight wood for about 72 hours at ambient temperature, about 20° C. The $KHSO_5$ is conveniently provided as the mixture $2KHSO_5.KHSO_4.K_2SO_4$, sold under the tradename OXONE by the Dupont Co.

After draining the pretreatment liquor the chips may then be pulped by standard methods, for example, soda or kraft pulping. The pulp so produced will have a lower kappa number, and as a result, lower viscosity and slightly lower yield than pulp produced from identical chips by an otherwise identical pulping process omitting the monopersulfate pretreatment.

Northern hardwood kraft pulp may be treated at about ten percent consistency with persulfate, conveniently provided as OXONE, at about 0.5 percent by weight $KHSO_5$ based on dry pulp weight for about 3.0 hours at slightly elevated temperature, conveniently about 50° C. followed by extraction with aqueous alkali, conveniently for about 30 minutes with about 0.35 percent by weight sodium hydroxide in water.

The resulting bleached pulp has a lowered permanganate number, substantial brightness improvement and only slightly lowered viscosity.

One skilled in the art will recognize that if additional brightness improvement is desired various known standard bleaching techniques such as ozone, chlorine, chlorine dioxide, and the like may be applied to the monopersulfate bleached pulp.

One skilled in the art will also recognize that in addition to the northern hardwood kraft pulp and the northern softwood chips illustrated, one may apply the persulfate treatment to other known lignocellulosic materials preferably in comminuted form such as chips prior to pulping by standard technique or to the pulps produced from such lignocellulosic materials to obtain analogous results.

While the preferred lignocellulosic species in addition to the northern hardwoods and softwoods illustrated are other woody materials especially tree woods including southern softwoods and hardwoods, other lignocellulosic species commonly employed in making pulp and paper may be employed. Illustrative of these non-woody species are such materials as the grasses, e.g. straw, bamboo, as well as, bagasse, kenaf hemp, jute, and the like.

The exact quantities of monopersulfate as well as the time and temperature of the treatment, when monopersulfate is employed as a pretreatment before pulping, are not particularly critical and may vary within wide limits. Amounts of monopersulfate from about 0.35% to about 35% by weight based on oven dry material may be employed for about 1 to about 72 hours at temperatures from about 20° C. to about 70° C.

Similarly the quantity of monopersulfate when employed as a post pulping bleach may vary widely as may the temperature and time.

Monopersulfate may be employed in amounts equivalent to from about 0.5% to about 5% $KHSO_5$, preferably from about 1.0% to about 3.0% by weight based on oven dry pulp for about 0.5 hours to about 3.0 hours at temperatures of from 20° C. to about 80° C., preferably from about 40° C. to 80° C.

The pH employed in either pretreatment or post pulping bleaching may also vary widely. pH values of from about 2.0 to about 12.0 preferably from about 3.0 to about 12.0 may be employed.

The counterion to the $HSO_5-$anion is also not particularly critical. In addition to the potassium cation specifically mentioned previously other alkali and alkaline earth metal cations may be employed. Illustrative of these, but not in limitation thereof are the cations of such metals as lithium, sodium, magnesium, cesium, and the like. In addition to cations derived from metals, other non-oxidizable cations, such as, those having the general formula

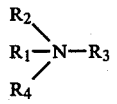

wherein $R_1$, $R_2$, $R_3$, and $R_4$ may be the same or different and are selected from hydrogen, straight, branched chain or cyclic alkyl of from 1 to about 20 carbon atoms, straight, branched chain or cyclic alkenyl of from 3 to about 20 carbon atoms, straight, branched chain or cyclic alkynyl of from 3 to about 20 carbon atoms, hydroxy alkyl of from 2 to about 20 carbon atoms or any 2 of $R_1$, $R_2$, $R_3$, and $R_4$ may be concatenated to form, when taken together with the nitrogen atom, a heterocyclic nucleus, such as, pyrolyl, pyridyl, pyrolidinyl, piperidyl, oxazolyl, pyrazolyl, imidazolyl, triazolyl, indolyl, indazolyl, tetrazolyl either unsubstituted or substituted with one or more alkyl, alkenyl, or carbocyclic or heterocyclic aryl moieties; or carbocyclic, or heterocyclic aryl.

Quaternary ammonium cations having at least one straight alkyl chain of at least 16 carbons may be particularly useful in producing softer, less adherent pulp with better hand for tissue and fluff pulp uses.

The substitution of one counter cation for another will be readily accomplished by one of skill in the art employing known standard techniques. Cation exchange employing known cation exchange resins is a particularly convenient method.

In addition to the kraft and soda pulping processes mentioned above, the term standard alkaline pulping processes comprehends all those known pulping processes which are conducted or which are initiated at pH values greater than 7. Illustrative of these processes are such methods as soda-oxygen, neutral sulfite semichemical, alkaline sulfite, polysulfide, bisulfite, alkaline sulfite, and sulfonated chemimechanical.

It will also be obvious to one of skill in the art that the use or the non-use of anthraquinone, anthrahydroquinone, and all related compounds well known in the recent literature in such standard alkaline pulping processes are also both comprehended by the invention.

The following examples further illustrate the best mode contemplated by the inventor for the practice of his invention.

The initial series of examples illustrate the use of monoperoxysulfate in the pretreatment of wood prior to chemical pulping. A series of samples of northern softwood chips having an average moisture content of 15% are treated by immersion in aqueous solutions of OXONE at varying weight concentrations relative to the oven dry weight of the wood at varying times and temperatures.

EXAMPLE 1

Wood chips (425 g) are immersed in liquor containing $KHSO_5$ (42.5 g) at a liquor to wood ratio of 7.6 to 1.0 at 20° C. for 72 hours. The chips are then drained, washed and soda pulped. Cooking conditions are 22% NaOH, 70 minutes to 170° C., 90 minutes at 170° C. and a liquor to wood ratio of 4 to 1. The resulting pulp has an unscreened Kappa number of 106.5, a screened Kappa number of 92.8, a yield of 51.6% and a viscosity (TAPPI T-230) of 18.2 cp.

From non-pretreated chips when subjected to the same cooking conditions, a pulp is obtained having an unscreened Kappa number of 130.3, a screened Kappa number of 117.3, a yield of 54.8%, and a viscosity of 35 cp.

EXAMPLE 2

Following a procedure analogous to that of Example 1 from 425 gms. of wood chips pretreated with 127.5 g $KHSO_5$ and pulped under similar conditions, a pulp is obtained having an unscreened Kappa number of 55.16 a screened Kappa number of 46.2, a yield of 45.8% and a viscosity of 18.8 cp.

EXAMPLE 3

Following a procedure analogous to that of Example 1 from 425 g of wood chips pretreated at 50° for 24 hours with 127.5 g $KHSO_4$ and pulped under similar conditions, a pulp is obtained having an unscreened Kappa number of 73.1, a screened Kappa number of 50.5 and a yield of 51.4%.

EXAMPLE 4

Following a pretreatment procedure analogous to that of Example 1 from 425 g of wood chips pretreated with 42.5 g $KHSO_5$ then subjected to kraft cooking at 14% active alkali, 20.6% sulfidity, 4:1 liquor to wood ratio, 70 minutes to 170° C., 80 minutes at 170° C., a pulp is obtained having an unscreened Kappa number of 74.7 and a yield of 51.4%.

From a similar pulp cooked under similar kraft conditions but not pretreated, a pulp is obtained having an unscreened Kappa number of 98.1 and a yield of 52.4%.

EXAMPLE 5

Following a procedure analogous to that of Example 4 from 425 g of wood chips pretreated with 85 g of $KHSO_5$ and then cooked under similar kraft conditions, a pulp is obtained having an unscreened Kappa number of 51.8 and a yield of 48.3%.

EXAMPLE 6

Following a procedure analogous to that of Example 4 from 425 g of wood chips pretreated with 127.5% $KHSO_5$ then pulped under similar kraft conditions, a pulp is obtained having an unscreened Kappa number of 23.7 and a yield of 43.1%.

EXAMPLE 7

Following a pretreatment procedure analogous to that of Examples 1 and 4, there is obtained from 425 g of wood chips pretreated with 42.5 g $KHSO_5$ and then kraft pulped at 18% active alkali, 20.6% sulfidity, 4 to 1 liquor to wood ratio, 90 minutes to 170° C. and 90 minutes at 170° C. a pulp having an unscreened Kappa number of 33.1 and a yield of 42.8%. From a similar pulp cooked under analogous conditions but not pretreated, a pulp is obtained having an unscreened Kappa number of 37.2 and a yield of 43.1%.

The following examples illustrate the use of monopersulfate in bleaching of pulp. A northern hardwood kraft pulp having an initial permanganate number (P-number) of 8.4, 25.8% brightness (G. E.) and a viscosity of 22.6 cp. is treated with OXONE at ten percent consistency at 50° C. for three hours. Twenty-five oven dried grams of pulp are used in each example. Following completion of the OXONE treatment all pulps are extracted with aqueous NaOH (0.35%) prior to determination of P-number, brightness and viscosity.

EXAMPLE 8

Pulp is treated with $KHSO_5$ (0.5 weight percent based on oven dry pulp) at pH 3.0 (adjusted with $H_2SO_4$). The pulp obtained has P-number 6.85, brightness 29.95%, viscosity 22.17 cp.

EXAMPLE 9

Following a procedure analogous to that of Example 8 except that pH of bleaching is 11.0 (adjusted by NaOH) there is obtained a pulp having P-number 6.5, brightness 30.35, viscosity 21.93 cp.

EXAMPLE 10

Following a procedure analogous to that of Example 8 except increasing the amount of $KHSO_5$ to 3.0 weight percent based on oven dried pulp, there is obtained a pulp having P-number 5.3, brightness 34.4%, viscosity 18.9 cp.

EXAMPLE 11

Following a procedure analogous to that of Example 9 except that the amount of $KHSO_5$ is increased to 3.0 weight percent based on oven dry pulp, there is obtained a pulp having P-number 5.25, brightness 35.7% and viscosity 19.4 cp.

The subject matter which applicant regards as his invention is particularly pointed out and distinctly claimed as follows:

1. A process for pulping wood chips comprising pretreating said wood chips with monoperoxy sulfuric acid or its salts at a pH within the range from about 2.0 to 12.0, wherein the pretreatment comprises a treatment time within the range about of 1 to about 72 hours at a temperature within the range from about 20° C. to about 70° C. and an amount of persulfate ion based on the oven dry weight of wood chips from about 0.35 percent to about 35 percent; following said pretreatment subjecting said pretreated chips to an alkaline pulping process.

2. A process as defined in claim 1 wherein the persulfate ion is supplied by potassium peroxydisulfate.

* * * * *